US006419229B1

(12) United States Patent
Whittington et al.

(10) Patent No.: US 6,419,229 B1
(45) Date of Patent: Jul. 16, 2002

(54) GOLF GAME

(75) Inventors: Robert Whittington, 512 E. Southlawn, Birmingham, MI (US) 48009; Robert Areddy, 626 Glen Cir., Rochester Hills, MI (US) 48307

(73) Assignees: Robert Whittington, Birmingham; Robert Areddy, Rochester, both of MI (US)

( * ) Notice: Subject to any disclaimer, the term of this patent is extended or adjusted under 35 U.S.C. 154(b) by 17 days.

(21) Appl. No.: 09/659,928

(22) Filed: Sep. 12, 2000

(51) Int. Cl.[7] ..... A63F 3/00

(52) U.S. Cl. ..... 273/245; 273/240; 273/134; 273/146; 273/282

(58) Field of Search ..... 273/245, 240, 273/264, 266, 271

(56) References Cited

U.S. PATENT DOCUMENTS 3,826,498 A * 7/1974 Monek ..... 273/134
4,277,065 A * 7/1981 White ..... 273/245
4,364,569 A * 12/1982 Duwell et al. ..... 273/245
4,380,338 A * 4/1983 Lacy ..... 273/245
4,759,548 A * 7/1988 Chaban ..... 273/245
4,809,985 A * 3/1989 Trimble ..... 273/245
5,000,460 A * 3/1991 Barbiaux et al. ..... 273/245
5,358,248 A * 10/1994 Jankosky ..... 273/153 J
5,924,693 A * 7/1999 Beaumier et al. ..... 273/245

* cited by examiner

*Primary Examiner*—Benjamin H. Layno
*Assistant Examiner*—Dolores R. Collins

(57) ABSTRACT

A new golf board game with a playing surface, said playing surface containing a plurality of golf links, each one of said golf links having a starting area, a fairway area, and a green area, said fairway areas and green areas also having proximate thereto certain strategically placed sand bunkers areas, and rough areas, and additionally one or more of said fairway areas also having at least one water hazard area proximate thereto, one regular die with the numbers one through six on the respective sides thereof, one lettered die with two letters "A" on random sides thereof, two letters "B" on random sides thereof, and a letter "C" and a letter "D" on the remaining two sides thereof, one putting die with random placement on two sides of the numeral "1", on two other sides the numeral "2", and on two other sides the numeral "3", between one to about 72 player marker piece(s) of any desired shape representing an individual player's golf ball, which pieces are moved around said playing surface during playing of the game, and a set of questions concerning the sport of golf, each said individual question being on individual question cards, there being between about 10 and about 700 of said question cards.

5 Claims, 2 Drawing Sheets

GOLF GAME

BACKGROUND OF THE INVENTION

The present invention relates to a golf game played on a surface which contains golf links printed thereon. More specifically, this invention relates to a golf board game having a playing surface with golf links thereon, and wherein the game is adapted for play by one or more players using dice, displaceable elements, and question cards in accordance with a set of game procedures and rules as disclosed herein.

The state-of-the-art is indicated by the following cited references: U.S. Pat. 5,924,693 to Beaumier et al.; U.S. Pat. No. 5,908,192 to West; U.S. Pat. No. 5,988,636 to Kilmer; and Design Pat. No. 416,053 to Chauvin.

Accordingly, it is an object of the invention to provide a unique new golf board game which can be played by one or more players utilizing dice and movable pieces.

Another object of the invention is to provide a new golf board game which closely simulates the play of a real game of golf, and yet which is easy and entertaining to play according to the game procedures and rules herein.

Another object of the invention is to provide a new golf board game which is foldable and storable when not in use.

Another object of the invention is to provide a new golf game which is played using various dice and movable pieces, and wherein numerous question cards are used in connection with movement of the game pieces.

Other objects, features and advantages of the present invention will become apparent from the subsequent description and the appended claims taken in conjunction with the accompanying drawings.

SUMMARY OF THE INVENTION

Figure 1:
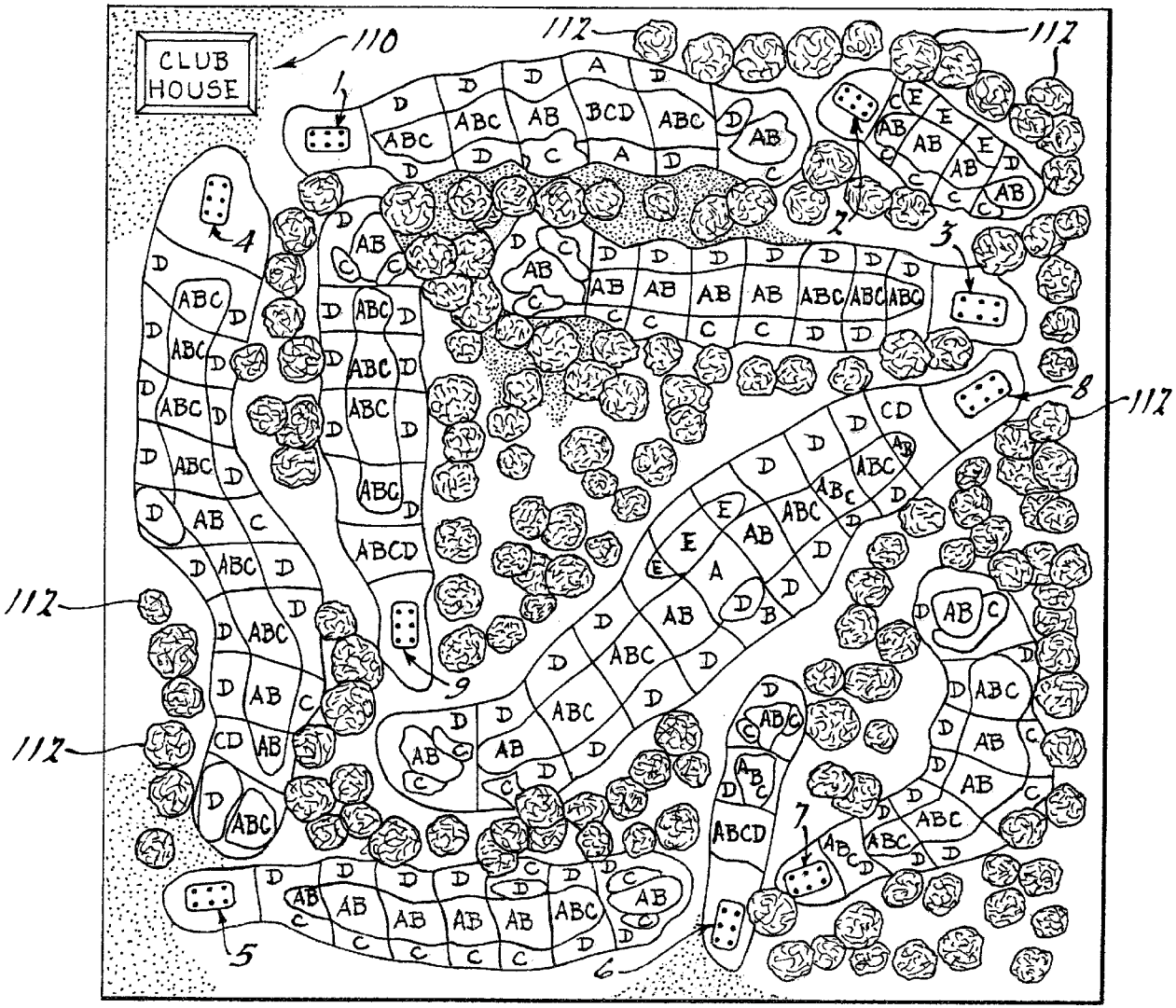
FIG. 1 illustrates a playing surface of the golf game in accordance with the invention and shows the layout of a first nine holes.

Briefly stated, the present invention involves a golf game comprising, a playing surface, said playing surface containing a plurality of golf links, each one of said golf links having a starting area, a fairway area, and a green area, said fairway areas and green areas also having proximate thereto certain strategically placed sand bunkers areas, rough areas, and additionally, one or more of said fairway areas also having at least one water hazard area proximate thereto, one regular die with the numbers one through six on the respective sides thereof, one lettered die with two letters "A" on random sides thereof, two letters "B" on respective sides thereof, and a letter "C" and a letter "D" on the remaining two sides thereof, one putting die with random placement on two sides of the numeral "1", on two other sides the numeral "2", and on two other sides the numeral "3", between one to about 72 player marker piece(s) of any desired shape representing an individual player's golf ball, which pieces are moved around said playing surface during playing of the game, and a set of questions concerning the sport of golf, each said individual question being on individual question cards (with the answers preferably being on the reverse side of each card), there being between about 10 and about 1,000 of said question cards, and preferably about 30 to about 500 of said cards.

From a method aspect, this invention involves a method of using a golf board game to play a simulated game of golf, said board game being comprised of, a playing surface, said playing surface containing a plurality of golf links, each one of said golf links having a starting area, a fairway area, and a green area, said fairway areas and green areas also having proximate thereto certain strategically placed sand bunkers areas, and rough areas, additionally one or more of said fairway areas also having at least one water hazard area proximate thereto, one regular die with the numbers one through six on the respective sides thereof, one lettered die with two letters "A" on random sides thereof, two letters "B" on respective sides thereof, and a letter "C" and a letter "D" on the remaining two sides thereof, one putting die with random placement on two sides of the numeral "1", on two other sides the numeral "2", and two other sides the numeral "3", between one to about 72 player marker piece(s) of any desired shape representing an individual player's golf ball, which pieces are moved around said playing surface during playing of the game, and a set of questions concerning the sport of golf, each said individual question being on individual question cards, there being between about 10 and about 700 of said question cards; and said method comprising the steps of:

(A) the first of a plurality of player(s) rolling said die with numbers 1 through 6 thereon to determine a number of linear spaces said player shall move forward on the hole being played, said first player also rolling the lettered die to produce one of said letters A, B, C and D to determine a lateral position on the fairway, bunkers, water hazard, and/or rough areas where said player shall position his (her) marker piece, (B) depending on where said player's marker piece lands, a set of game rules are applied utilizing said question cards, (i) if the player's marker piece lands in the fairway no response to a question card is necessary, and it becomes the next player's turn to roll the die, (ii) if the player's marker piece lands in one of the rough, sand, and water hazard areas, the player must respond to a question card, if the question is answered correctly the turn is passed on to the next player, if the question is answered incorrectly the following penalties apply;

(a) rough—the player moves one space backward, the type of space moved to (fairway, rough, sand, water hazard) is unimportant, (b) sand—the player adds one stroke to his score, (c) water hazard—the player adds one stroke to his (her) score and moves the player's marker piece 1 space backward, the type of space moved to is unimportant, (C) the next said player in rotation rolling said die as in step (a) to determine where said next player shall move his (her) marker piece to, (D) once each player in the group lands his (her) marker piece on the green area, he (she) then rolls the putting die to receive either a "1", "2" or "3" from the roll, and then he (she) must respond to a question card, and if the question is answered correctly, he (she) adds one less than the amount rolled to his (her) score for that hole, and if he (she) gets the question incorrect, then he (she) adds the amount that was rolled to his (her) score for that hole, (E) and the number of strokes taken by each player on each hole is recorded on a score sheet, with the player having the lowest score at the end of playing being the winner.

DESCRIPTION OF PREFERRED EMBODIMENTS

The drawings, in accordance with the invention, are now described.

FIG. 1 illustrates a nine hole golf layout wherein the various starting tee boxes are designated 1, 2, 3, 4, 5, 6, 7, 8 and 9 respectively. It will be appreciated that the layout of these golf holes can be in numerous different configurations and shapes, and the layout shown in FIG. 1 is only a typical or preferred layout.

Each one of the golf holes 1, 2, 3 etc. has a fairway area marked off in different sections with the letters A, B, C or D down the middle of the hole. The rough areas to either the left or right of the fairway is also marked with various letters also such as A, B, C or D. The green for hole No. 1 is marked with the letter designations A, B. And the rough area behind the green on hole No. 1 is marked with the letter C as shown in FIG. 1. There is also a sand bunker in the front left of the green for hole No. 1 marked with the designation D. The water hazard areas throughout the golf layout are designated E.

Similarly, the hole designated No. 2 has its tee box marked with the numeral 2 and the fairway area is marked with the various letter designations A and/or B. The green for hole No. 2 is marked with the letters A, B. The rough areas along hole No. 2 are marked with the letters C or D. A similar arrangement is used for marking the fairways, bunkers, water hazards (e.g., see the water hazard area designated E along hole No. 2 and hole No. 8) and green areas of holes 3, 4, 5, 6, 7, 8 and 9, all of which are shown in FIG. 1.

Figure 2:
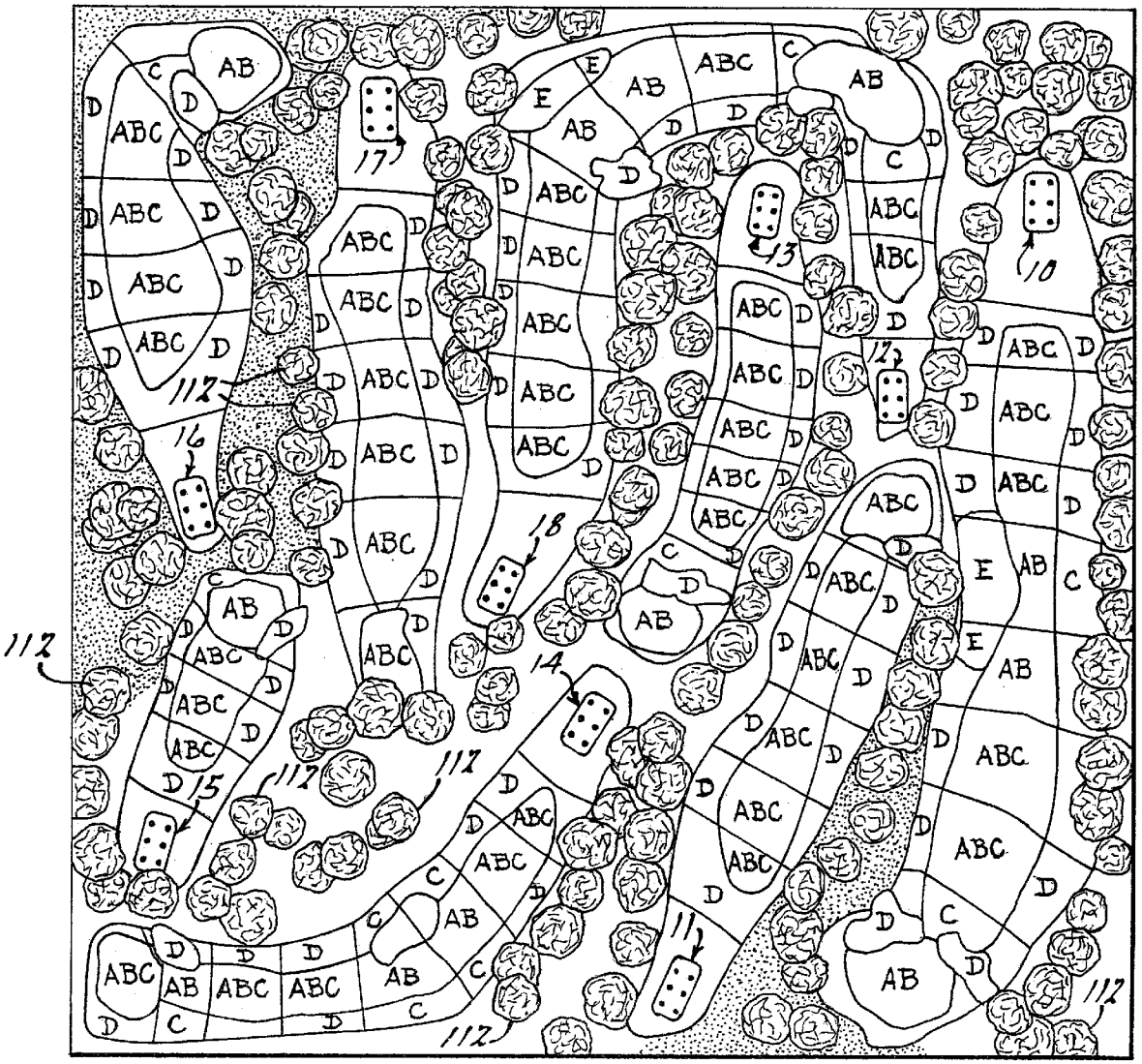
FIG. 2 illustrates another playing surface in accordance with the golf game of the invention and shows the layout of the back nine holes.

FIG. 2 illustrates a back nine configuration for a preferred golf course layout in accordance with the invention. The golf holes in FIG. 2 are designated by numerals placed in the starting tee box areas with the holes having starting tee boxes designated by the numerals 10, 11, 12, 13, 14, 15, 16, 17 and 18. Similarly, to the preferred markings used in FIG. 1, the hole No. 10 for example, is marked in its fairway sections with the letters A, B or C. And its rough areas are marked with the letters C or D. The green for hole No. 10 is marked with the letters A, B. And there are two sand bunker areas in the front of the green for hole No. 10 with those sand bunker areas being designated by the letters D.

In a similar fashion, the fairways, rough areas, sand bunkers areas, and water hazard areas (e.g., see water hazards designated E on hold No. 10 and hole No. 18) used in holes 11, 12, 13, 14, 15, 16, 17, and 18 are similarly marked.

Figure 3:
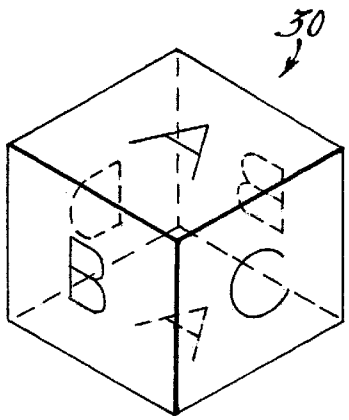
FIG. 3 illustrates one rollable die in accordance with the invention.

FIG. 3 illustrates a lettered die with six sides thereon, and said letter die is designated 30.

Figure 4:
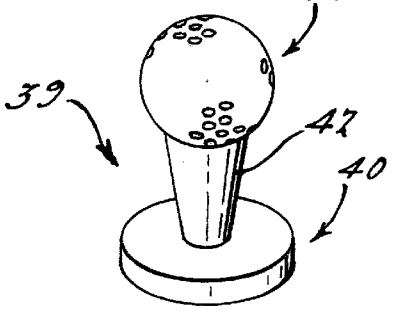
FIG. 4 illustrates a typical movement piece which may be used in accordance with the invention.

FIG. 4 illustrates a preferred game marker piece 39 which preferably is of a small hand held size, and is comprised of a round or circular base 40 with a T-shaped support member designated 42, and a top portion designated 44 in the shape of a small golf ball. This is only a preferred example, and numerous shapes or sizes for the marker pieces may be used.

As will be understood numerous different types of hole layouts or hole configurations can be used and the sand bunker areas, rough areas, and water hazard areas can be placed in numerous different positions and/or configurations. The nine hole layout shown in FIG. 1 and the back nine layout shown in FIG. 2 are only preferred layouts for purposes of describing this invention.

FIG. 1 also has a clubhouse designated by the numeral 110 and is preferably positioned near the starting tee box designated 1. The numerous trees on the front nine and the back nine are designated 112.

The object of the game (stroke play) is to finish 9 or 18 holes of golf with the lowest score. The number of players is one or more, up to as many for example, as 72 players. For example, if 72 players were playing the game, a single time "shotgun" start would be used as is known in the game of golf. The question cards; in accordance with the invention two stacks of question cards are preferably used, as will be explained in more detail. For example, a yellow stack of cards may be used when a player lands in the rough, sand, or water hazard. These cards contain questions based on the golf Majors, for example, the PGA Tour, The Ryder Cup, and/or other tournaments and golf events, or golf history questions from the U.S.A. and the rest of the world.

An orange stack of cards may also be used under preferable circumstances, wherein when a player lands on the green pursuant to movement of the game pieces herein (as will be explained below), these orange question cards contain questions about the rules of golf. As will be understood, the question cards can be of numerous different colors and/or shapes.

Golf Board Game Questions 12 sample questions (these are only typical or preferred examples; hundreds more can be added, as will be apparent to those skilled in the game of golf)

Game will have approximately 500–1,000 total questions

Some example multiple choice

Questions on: 1. Rules/History
2. The Majors
3. The Ryder Cup
4. The PGA Tour

1. Who won the 1986 US Masters?
   A-Jack Nicklaus
2. Who has won the most PGA Tour Events in their career?
   A-Sam Snead
3. What is the standard loft on a Sand Wedge?
   A-56 degrees
4. Who is the winningest player in Ryder Cup History, all matches?
   A-Nick Faldo
5. What is the par of the seventh hole at the Augusta National G.C.
   A-Four
6. Where was the 1977 Ryder Cup held?
   A-The Greenbrier
7. Who finished $2^{nd}$ to Jack Nicklaus at the 1980 US Open?
   A-Andy North
8. What measures 1.68 inches?
   A-a golf ball
9. In strokeplay, what is the penalty for striking your golf bag with your golf ball?
   A-2 strokes 10. Hold old was young Tom Morris when he died?
A-24 years old
11. At which famous golf course is Hell's Bunker?
A-St. Andrews
12. Who won the 1972 PGA Championship?
A-Gary Player Beginning play in the game: each of the players in the game rolls a dice with numerals 1 to 6 thereon (no shown, but typical in the art), to determine the starting order of players. The highest roll goes first and the order remains constant throughout the game.

Play of the game: the players participating begin at the tee box of the first hole. The numerical die and a letter die 30 are thrown to determine the golf shot. The player "hits" his/her golf ball toward the green one longitudinal space for each number on the numerical die which is rolled. The accuracy of the shot is determine by the lettered die, and the player then places his golf ball or marker piece 39 in the lateral space which contains the letter of the die rolled. One stroke is then added to the player's score. If the numerical die is more than the number of spaces to the green, the golf ball or player's marker piece remains in the last space on the hole.

The questions or question cards used in the game: based on where the player's ball (marker piece) lands the following rules apply. Fairway—if a player's marker piece lands in the fairway, he is not asked a question and the turn passes to the next player.

When a player lands in the rough, sand or water hazard he (she) is asked a question from a colored stack of cards (e.g., blue, white, red, yellow, orange, etc.). The category is based on the color of the tee marker from which the ball was teed off. If the question is answered correctly, the turn is then passed on the to the next player and no penalty is given. If the question is answered incorrectly, the following penalties apply.

Rough—the players moves his marker piece one space backward. The type of space the player moves to (fairway, rough, water hazard etc.) is not important.

Sand—the player adds one stroke to his score.

Water Hazard—the player adds one stroke to his score and moves his marker piece one space backward. Again, the type of space the player moves to is not important.

If the player lands on the green, he roles a green colored die. Then the player is asked a question from another colored stack of question cards. If he (she) gets the question incorrect, the player adds the amount that was rolled on the green die to his (her) score. If the player gets the question right, he (she) adds one less than the amount that was rolled on the green die to his/her score, that is, if the player roles three, and gets the question right, then the player adds only two to his score for that hole.

Recording the player's score: the number of strokes taken on a give hole is recorded on a score sheet used in the game. At the end of each nine (or eighteen holes, the number of holes to be played being decided between the players before start of the game) the strokes are added up to determine the winner.

Sudden death: at the end of regulation play, that is either nine or eighteen holes, (which was decided by all players at the start of the game), the score on each hole is added up to determine the winner. If two or more players are tied, the tied players begin a playoff on the first hole to determine the winner through a sudden death playoff system. The players play the first hole as done in regulation play. At the end of that first hole, only the players with the lowest score continue to the next hole, and so on, and this is continued until there is only one player remaining, who is then declared the winner.

Formats of golf that can be played in accordance with the invention: virtually any format of golf competition can be played using this game, for example, a scramble format, match play, best ball, stroke play, etc.

While it will be apparent that the preferred embodiments of the invention disclosed are well calculated to fulfill the objects, benefits and/or advantages of the invention, it will be appreciated that the invention is susceptible to modification, variation and change without departing from the proper scope or fair meaning of the subjoined claims.

What is claimed is:

1. A golf game comprising:

a playing surface, said playing surface containing a plurality of golf links, each one of said golf links having a starting area, a fairway area, and a green area, said fairway areas and green areas also having proximate thereto certain strategically placed sand bunker areas, and rough areas, additionally one or more of said fairway areas also having at least one water hazard area proximate thereto, one regular die with the numbers one through six on the respective sides thereof, one lettered die with two letters "A" on random sides thereof, two letters "B" on respective sides thereof, and a letter "C" and a letter "D" on the remaining two sides thereof, one putting die with random placement on two sides of the numeral "1", on two other sides the numeral "2", and on two other sides the numeral "3", between one to about 72 player marker piece(s) of any desired shape representing an individual player's golf ball, which pieces are moved around said playing surface during playing of the game, and a set of questions concerning the sport of golf, each said individual question being on individual question cards, there being between about 10 and about 700 of said question cards, and wherein, there is also included a set of instructions and rules for playing the game, and said playing surface is a foldable game board having said golf links printed thereon, and said fairway areas each being marked with combinations of the letters "A", "B", "C" and "D" to indicate positions where each respective player's golf ball will be placed after a roll of the die.

2. A golf game as set forth in claim 1 wherein, said golf links include 18 different golf holes.

3. A method of using a golf board game to play a simulated game of golf, said golf board game being comprised of, a playing surface, said playing surface containing a plurality of golf links, each one of said golf links having a starting area, a fairway area, and a green area, said fairway areas and green areas also having proximate thereto certain strategically placed sand bunkers areas, and rough areas, additionally one or more of said fairway areas also having at least one water hazard area proximate thereto, one regular die with the numbers one through six on respective sides thereof, one lettered die with two letters "A" on random sides thereof, two letters "B" on respective sides thereof, and a letter "C" and a letter "D" on the remaining two sides thereof, one putting die with random placement on two sides of the numeral "1", on two other sides the numeral "2", and two other sides the numeral "3", between one to about 72 player marker piece(s) of any desired shape representing an individual player's golf ball, which pieces are moved around said playing surface during playing of the game, and a set of questions concerning the sport of golf, each said individual question being on individual question cards, there being between about 10 and about 1,000 of said question cards said method comprising the steps of:

(A) the first of a plurality of player(s) rolling said die with numbers 1 through 6 thereon to determine a number of linear spaces said player shall move forward on the hole being played, said first player also rolling the lettered die to produce one of said letters A, B, C and D to determine a lateral position on the fairway, bunkers, water hazard, and rough areas, where said player shall position his (her) marker piece, (B) depending on where said player's marker piece lands, a set of game rules are applied utilizing said question cards, and (i) if the player's marker piece lands in the fairway no response to a question card is necessary, and it becomes the next player's turn to roll the die, (ii) if the player's marker piece lands in one of the rough, sand, and water hazard areas, the player must respond to a question card, whereby if the question is answered correctly the turn is passed on to the next player, and if the question is answered incorrectly the following penalties apply;

a) rough—the player moves one space backward, the type of space moved to (fairway, rough, sand, water hazard) is unimportant, b) sand—the player adds one stroke to his (her) score, c) water hazard—the player adds one stroke to his (her) score and moves the player's marker piece 1 space backward, the type of space moved to is unimportant, (C) the next said player in rotation rolling said die as in step (A) to determine where said next player shall move his (her) marker piece to, (D) once each player in the group lands his (her) marker piece on the green area, he (she) then rolls the putting die to receive either a "1", "2" or "3" from the roll, and then he (she) must respond to a question card, and if the question is answered correctly, he (she) adds one less than the amount rolled to his (her) score for that hole, and if he (she) gets the question incorrect, then he (she) adds the amount that was rolled to his (her) score for that hole, (E) and the number of strokes taken by each player on each hole is recorded on a score record, with the player having the lowest score at the end of playing being the winner.

4. The method of claim 3 wherein, if two or more players are tied at the end of play, then those players that are tied begin play again on the first hole of the board game, and continue play as in steps (1) through (5), whereafter at the end of that first hole, and each succeeding hole thereafter if necessary, only the player with the lowest score continues to play until there is only one player remaining, who is then the winner.

5. A golf game comprising:

a playing surface, said playing surface containing a plurality of golf links, each one of said golf links having a starting area, a fairway area, and a green area, said fairway areas and green areas also having proximate thereto certain strategically placed rough areas, one regular die with numbers on the respective sides thereof, one lettered die with letters on random sides thereof, one putting die with random placement of numbers thereon, between one to about 72 player marker piece(s) of any desired shape, which pieces are moved around said playing surface during playing of the game, and a set of questions concerning the sport of golf, each said individual question being on individual question cards, there being between about 10 and about 1,000 of said question cards, and wherein, there is also included a set of instructions and rules for playing the game, and said playing surface is a foldable game board having said golf links printed thereon, and said golf links include at least nine different golf holes.

* * * * *